US009708755B2

(12) United States Patent
Koene et al.

(10) Patent No.: US 9,708,755 B2
(45) Date of Patent: Jul. 18, 2017

(54) FLUID-RESISTANT TEXTILE FABRICS AND METHODS

(75) Inventors: Bryan Edward Koene, Blacksburg, VA (US); Ruya Ozer, Tulsa, OK (US)

(73) Assignee: LUNA INNOVATIONS INCORPORATED, Roanoke, VA (US)

( * ) Notice: Subject to any disclaimer, the term of this patent is extended or adjusted under 35 U.S.C. 154(b) by 205 days.

(21) Appl. No.: 14/131,110

(22) PCT Filed: Jun. 29, 2012

(86) PCT No.: PCT/US2012/044784

§ 371 (c)(1),
(2), (4) Date: Apr. 14, 2014

(87) PCT Pub. No.: WO2013/058843

PCT Pub. Date: Apr. 25, 2013

(65) Prior Publication Data

US 2014/0220840 A1 Aug. 7, 2014

Related U.S. Application Data

(60) Provisional application No. 61/504,548, filed on Jul. 5, 2011.

(51) Int. Cl.

| | |
|---|---|
| ***D06M 15/277*** | (2006.01) |
| ***D06M 11/36*** | (2006.01) |
| ***D06M 11/78*** | (2006.01) |
| ***D06M 23/08*** | (2006.01) |
| ***D06B 1/00*** | (2006.01) |
| ***D06M 11/79*** | (2006.01) |
| ***D06M 11/53*** | (2006.01) |
| ***D06M 11/58*** | (2006.01) |
| ***D06M 11/74*** | (2006.01) |

(52) U.S. Cl.

CPC ..... *D06M 15/277* (2013.01); *D06B 1/00* (2013.01); *D06M 11/36* (2013.01); *D06M 11/53* (2013.01); *D06M 11/58* (2013.01); *D06M 11/74* (2013.01); *D06M 11/78* (2013.01); *D06M 11/79* (2013.01); *D06M 23/08* (2013.01); *D06M 2200/11* (2013.01); *D06M 2200/12* (2013.01); *D06M 2200/35* (2013.01); *Y10T 442/2172* (2015.04)

(58) Field of Classification Search

CPC ..... D06B 1/00; D06M 11/36; D06M 11/78; D06M 11/79; D06M 15/277; D06M 2200/11; D06M 2200/12; D06M 2200/35; D06M 23/08; D06M 11/53; D06M 11/58; D06M 11/74; Y10T 442/2175

USPC ..... 977/701, 707, 773, 775, 779, 902, 961; 428/923, 924, 925, 543, 402, 357–401, 428/220; 442/59, 79, 80, 82, 86, 87, 88, 442/91, 92; 252/8.62; 28/165, 169

See application file for complete search history.

(56) References Cited

U.S. PATENT DOCUMENTS

| | | | | |
|---|---|---|---|---|
| 8,314,037 | B2 * | 11/2012 | Brown et al. | 442/80 |
| 2009/0011222 | A1 * | 1/2009 | Xiu et al. | 428/323 |
| 2009/0076198 | A1 | 3/2009 | Giesenberg et al. | |
| 2009/0176056 | A1 | 7/2009 | Marin | |
| 2010/0112204 | A1 | 5/2010 | Marte et al. | |
| 2013/0182331 | A1 * | 7/2013 | Hebrink | 359/601 |

FOREIGN PATENT DOCUMENTS

| | | |
|---|---|---|
| EP | 1 283 295 | 4/2010 |
| EP | 12 832 95 | 4/2010 |
| KR | 10-2010-0087526 | 8/2010 |
| KR | 10-2010-0110810 | 10/2010 |
| WO | 2006/084413 | 8/2006 |

OTHER PUBLICATIONS

Supplementary European Search Report dated Jan. 27, 2015.
International Search Report for PCT/US2012/044784, mailed Jun. 1, 2013.

* cited by examiner

*Primary Examiner* — Arti Singh-Pandey
(74) *Attorney, Agent, or Firm* — Nixon & Vanderhye P.C.

(57) ABSTRACT

Coating compositions which include a blend of a fluorochemical and a particulate additive comprising a bimodal size distribution of inorganic nanoparticles are provided. The bimodal distribution of inorganic nanoparticles may include a quantity of smaller nanoparticles having an average size distribution of between about 1 to about 15 nm, and a quantity of larger nanoparticles having an average size distribution of between about 40 to about 500 nm. The smaller and larger nanoparticles may be present in a ratio of the smaller sized particles to the larger sized particles of at least 1.2, with the total amount of nanoparticles being present in an amount of between about 0.1 to about 10 wt. % based on total composition weight.

9 Claims, 1 Drawing Sheet

FLUID-RESISTANT TEXTILE FABRICS AND METHODS

CROSS-REFERENCE

This application is the U.S. national phase of International Application No. PCT/US2012/044784, filed 29 Jun. 2012, which designated the U.S. and is based on and claims domestic priority benefits under 35 USC §119(e) from U.S. Provisional Application No. 61/504,548, filed 5 Jul. 2011, the entire contents of each of which are hereby incorporated by reference.

GOVERNMENT RIGHTS

This invention was made with Government support under Contract No. W911QY-10-C-0071 awarded by the Department of the Army. The Government has certain rights to the invention.

FIELD

The disclosed embodiments herein relate to coating compositions which impart fluid-resistance properties to textile articles, especially textile fabrics. In preferred forms, the coating compositions are especially formulated to impart resistance to wetting by low surface tension fluids.

BACKGROUND

The use of fluoropolymers to produce hydrophobic surfaces that will repel water are known. However, conventional fluoropolymer treatments of textile fabrics have several disadvantages, including (i) relatively high loadings on the fabric in order to achieve desired hydrophobicity, (ii) inadequate wash durability characteristics, and (iii) inadequate low surface energy characteristics required for superoleophobic or oil repellency.

Quarpel (acronym for "Quatermaster Repellent") fabrics have also been used extensively to provide water and stain resistances for textile fabrics, especially rain and chemical resistant combat clothing.

The following non-exhaustive listing of prior proposals in the art will provide additional background to the embodiments disclosed herein:

Leng et al, *Langmuir,* 2009, 25 (4), pp 2456-2460, describes the deposition of a textured surface with superhydrophobic and superoleophobic behavior. The disclosed surface treatment however has shortcomings due to degradation of the fabric thereby resulting in very poor mechanical properties as measured by standard industry test methods. In addition, the process for the disclosed treatment also involves many steps thereby presently practical manufacturing difficulties using conventional textile process equipment.

Choi et al, Adv. Mater. 2009, 21, 2190-2195, report the use of fluorinated polyhedral oligomeric silsesquioxane (F-POSS) for textile treatments to achieve hydrophobicity.

U.S. Pat. No. 7,879,743 describes the use of surface treated particles and a fluorochemical to produce oil and water repellency. Specifically, the '743 patent teaches that silane coupling agents and a relatively narrow size distribution of the particles are necessary for adequate repellency performance characteristics.

SUMMARY OF EXEMPLARY EMBODIMENT

One object of the present invention is to provide a finish treatment for textile substrates that is highly repellent to both water and oil and remains durable even under stress including abrasion, laundering and use.

It is a further object of the invention to provide a finish treatment for textiles which does not (or at least not noticeably) alter the appearance, feel or hand of the textile substrate.

According to some aspects of the present invention therefore, these objectives are achieved through the application of a hydrophobic coating containing a combination of particles with a multi-modal, preferably bimodal, distribution of particle sizes.

These and other aspects of the present invention will become more clear after careful consideration is given to the following detailed description of a presently preferred exemplary embodiment thereof.

DEFINITIONS

The terms below as used herein and in the accompanying claims are intended to have the following definitions.

"Filament" means a fibrous strand of extreme or indefinite length.

"Fiber" means a fibrous strand of definite length, such as a staple fiber.

"Yarn" means a collection of numerous filaments or fibers which may or may not be textured, spun, twisted or laid together.

"Fabric" means a collection of filaments, fibers and/or yarns which form an article having structural integrity. A fabric may thus be formed by means of conventional weaving, braiding, knitting, warp-knit weft insertion, spinbonding, melt blowing techniques to form structurally integrated masses of filaments, fibers and/or yarns.

"Synthetic" means that the textile article is man-made from a fiber-forming substance including polymers synthesized from chemical compounds, modified or transformed natural polymers, and minerals. Synthetic fibers are thus distinguishable from natural fibers such as cotton, wool, silk and flax.

"Low Surface Tension Liquid" means a liquid having a surface tension of less than 47 mN/m (e.g., ethylene glycol), preferably less than 27 mN/m (e.g., hexadecane).

DETAILED DESCRIPTION

Figure 1:
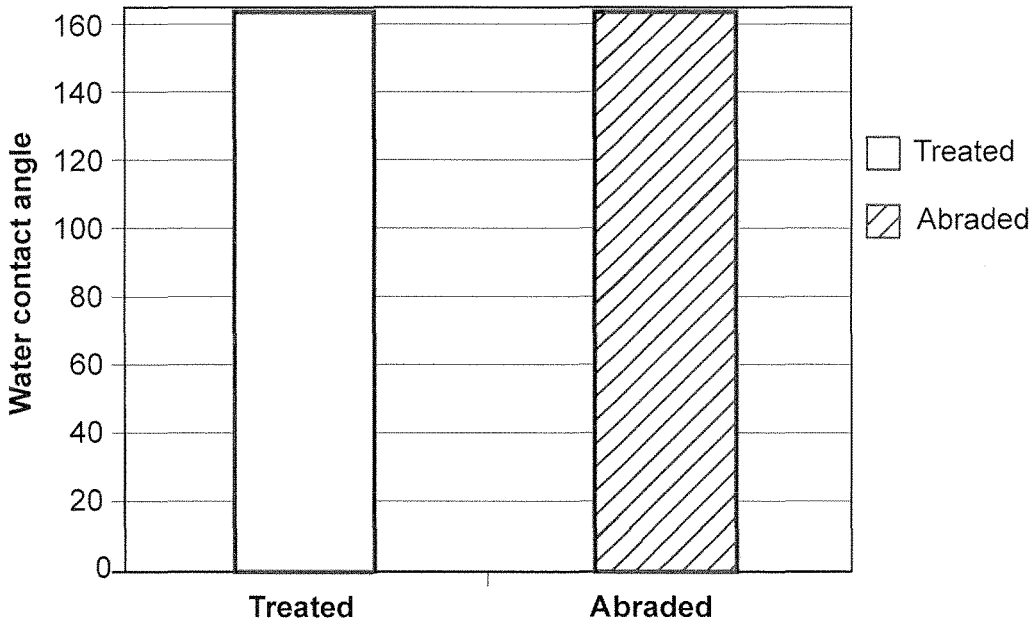
FIG. 1 is a bar graph showing the contact angles of a treated fabric following Taber abrasion according to Example 4 below.

Hydrophobic coatings of the present invention may contain a polymeric matrix formed from a polymer or mixture of polymers where at least one component of the coating imparts water and oil repellency to the coated object. It may additionally be advantageous for the polymer to contain one or more different groups that can crosslink to each other or to the materials being coated. Preferably, the component imparting water and oil repellency is a fluorinated polymer or fluorochemical that will contain some perfluorinated or partially fluorinated alkyl chains or other organo-fluorine groups.

The water and oil repellency of the hydrophobic coatings of the present invention is greatly increased through the inclusion of nanoscale sized particles in the polymer or polymer mixture where the size distribution of the particles is multimodal. Preferably, a bimodal distribution of particles is desired where smaller particles of a mean particle diameter of between about 1 to about 15 nm, preferably between about 5 to about 10 nm, is combined with other particles having a mean particle diameter in the range of between about 40 to about 500 nm, preferably between about 40 to about 100 nm. The ratio of mean particle diameter of the smaller sized particles to the larger sized particles is preferably at least 1:2, more preferably about 1:3.

Fluorochemicals useful for the practice of the invention include any of the commercial fluorochemicals used to impart stain and oil/water resistance to textile fabrics. Fluorochemicals are typically complex random co-polymers that contain a variety of substituents including, fluoroalkyl co-monomers containing organo-fluorine groups that provide both water and oil repellency, non-fluorinated co-monomers such as alkyl monomers to provide water repellency and to achieve good film-forming properties, small amounts of hydrophilic monomers to aid in stabilization of the polymer in aqueous solution, and cross-linkable groups such as amines so that the complex polymer can be permanently cross-linked to functional groups on the natural or synthetic fabric. Suitable fluorochemicals include any of the organo-fluorine group-containing organic compounds including polymeric and oligomeric compounds. These polymeric and oligomeric compounds typically contain one or more organo-fluorine groups that contain a perfluorinated carbon chain having from 2 to about 16 carbon atoms and preferably 4 to 8 carbons. The organo-fluorine groups may be straight-chained, branched or cyclic fluorinated alkyl or alkylene groups. Fully fluorinated groups are preferred. Perfluorinated aliphatic groups of the general formula ($C_nF_{2+1}$ where n is an integer of at least 1) are the most preferred organo-fluorine groups. Especially preferred are organo-fluorine groups wherein n is between 4 and 8, since such groups show the least toxicity and persistence in the environment.

The fluorochemicals useful in the invention preferably contain non-fluorinated co-monomers. It is preferred that the concentration of non-fluorinated co-monomers be as high as possible without sacrificing the stain and water/oil repellent properties of the polymer. Typical non-fluorinated co-monomers may be methyl methacrylate, dodecylmethacrylate, octadecylmethacrylate, butyl acrylate, and polyvinylchloride. The non-fluorinated co-monomers may also contain hydrophilic groups to aid in the dispersibility of the polymer in aqueous solution, examples include polyethyleneglycol-methacrylates and -acrylates, and 2-hydroxyethylacrylate.

The fluorochemicals useful in the invention also preferably contain a cross-linkable moiety. A cross-linkable moiety refers to an organic functional group that may react at a temperature between about 20-150° C. and form a covalent bond with functionalities on the surfaces of the individual fibers of the fabric. The functional group may react directly with functionalities on the surface of the individual fibers or may react with a "cross-linker", a molecule that has multiple reactive sites and essential binds, or reacts with, both the fluoropolymer and the fabric. Examples of cross-linkable moieties include vinyl, acrylic, carboxylate, hydroxyl, amine, amide, thiol, and silane groups. Examples of cross-linkers include melamine resins, isocyanates and polyisocyanates. Preferred cross-linkers are blocked polyisocyanates which react only at elevated temperatures usually during the drying and curing stages.

Fluorochemicals are typically provided to the textile industry as a concentrate that is later diluted to a specific concentration and is then applied to the fabric. The term "treating solution" is hereafter used to refer to the diluted concentrate (which may include additives such as surfactants, wetting aids, solvents, cross-linkers, etc.) that is applied to the fabric. The treating solution is applied to the fabric by padding (dipping), spraying or foaming of the fabric with the solution. The wet pickup of the fabric typically ranges from 20-80% (by weight). One skilled in the art may determine the proper dilution of the concentrate by knowledge of the fabric weight and the wet pick-up of the particular process used and the desired performance (water and oil repellency rating) of the fabric.

As described above, fluorochemicals are typically complex random co-polymers and contain a variety of substituents in addition to organo-fluorine containing components. Further, the percentage of organo-fluorine containing monomers and the chemical structure of the monomers may vary significantly between different manufacturers. In addition, fluorochemicals may contain emulsifiers and dispersion aids, and may be sold at a variety of concentrations, i.e., as measured by the percentage of solids.

The particles of the invention have a size distribution of particles that is multi-modal. Multi-modal distributions of particle sizes is achieved by combining two or more particles of dissimilar mean sizes. Preferably, a bimodal distribution of particle is used with the smaller sized particles having size distributions in the range of between about 1 to about 15 nm, preferably between about 5 to about 10 nm and the larger sized particles having a size distribution of between about 40 to about 500 nm, preferably between about 40 to about 100 nm.

The particles employed in the textile coatings of the present invention can be inorganic or polymeric that are capable of being dispersed as a colloidal solution. Preferably, the particles are inorganic materials that are at least one of an oxide, sulfide, oxyhydrate, nitride or carbide of Si, Al, Zn, Zr, or any combination thereof that is capable of being disbursed as a colloidal solution. Most preferred are colloidal silica particles.

The particles employed in the textile coatings of the present invention are most preferably added to the hydrophobic coating at a concentration of between about 0.1 to about 10 wt. %, more preferably between about 1 to about 2% wt. %. based on the total coating weight.

The coated textile articles according to embodiments of the present invention can be fabricated in a number of ways. For example, the multi-modal size distribution of particles can be formulated in one-step process with all other components to form a coating composition that can then be applied to a surface of a textile article. The one-step process may be modified so that the multi-modal size distribution of particles may be applied onto a surface of a textile article with all components other than a fluorocompound, which can subsequently be applied onto the multi-modal particles. Alternatively, the multi-modal size distributions of particles can be blended separately with other components and then applied sequentially onto a surface of a textile article, which case a further step of applying a finishing resin with the fluorocompound is preferably practiced. Other application variations can also be envisioned. For example, it is possible in one step to apply one particle size combined with a crosslinking agent, and thereafter in a second step the other particle size distribution with the crosslinking compound and the fluorocompound can be applied.

The present invention will be further understood by reference to the following non-limiting Examples. In the Examples, the following components were used:

Mykon® NRW-3: amine oxide non-rewetting surfactant (OMNOVA Solutions Inc.)

Envirogem® AE02: readily-biodegradable nonionic surfactant (100% active liquid) (Air Products, Inc.)

Nuva™ HPU: perfluoroalkylacrylate copolymer textile finish (Clariant Corporation)

X-Cape® LK-30: crosslinker (OMNOVA Solutions Inc.)

Permafresh® CSI: pre-catalyzed ultra-low formaldehyde thermosetting resin (OMNOVA Solutions Inc.)

AEROSIL® 380: hydrophilic fumed silica with a specific BET surface area of 380 $m^2/g$ (±30 $m^2/g$) (Degussa GmbH)

AEROSIL® OX50: hydrophilic fumed silica with a specific BET surface area of 50 $m^2/g$ (±15 $m^2/g$) (Degussa GmbH)

X-Cape® DRC—(Omnova Solutions Inc.)—perfluoroalkylacrylate copolymer textile finish X-Cape® B2012—(Omnova Solutions Inc.)—perfluoroalkylacrylate copolymer textile finish Snowtex OL (Nissan Chemical)—colloidal silica (40-50 nm diameter)

Snowtex O (Nissan Chemical)—colloidal silica (10-20 nm diameter)

AdvaPel H734 (API)—fluorochemical finishing agent

AdvaPel J5290 (API)—fluorochemical finishing agent

Example 1 (Formulations A-D)

Fabric finish formulation was produced as shown in Table 1 below. Silica particles with different sizes were used (7 nm and 40 nm). Formulations included no particles, both size particles, or each of the single sized particles. Woven fabrics (50:50 Nylon-cotton blend, and acrylic fabric) were dipped in solutions, padded, and heated to 150° C. for 6 minutes.

TABLE 1

Formulations for Example 1

| CHEMICALS | A No particles | B Dual Particles | C Particle 1 | D Particle 2 |
|---|---|---|---|---|
| Water | 85 | 83 | 83 | 83 |
| Mykon ® NRW-3 | 0.5 | 0.5 | 0.5 | 0.5 |
| Envirogem ® AE02 | 0.5 | 0.5 | 0.5 | 0.5 |
| Nuva ™ HPU | 6 | 6 | 6 | 6 |
| X-Cape ® LK-30 | 4 | 4 | 4 | 4 |
| Permafresh ® CSI | 4 | 4 | 4 | 4 |
| AEROSIL ® 380 | 0 | 1 | 2 | 0 |
| AEROSIL ® OX50 | 0 | 1 | 0 | 2 |
| | 100 | 100 | 100 | 100 |

Table 2 below shows octane contact angles for each of the fabrics. The oil repellency ratings was measured according to AATCC Method 118 using the following liquid score:

| Fluid | Rating | Surface Tension (mN/m) |
|---|---|---|
| Mineral oil | 1 | 35.0 |
| 65/45 mineral oil/ hexadecane | 2 | 31.2 |

-continued

| Fluid | Rating | Surface Tension (mN/m) |
|---|---|---|
| Hexadecane | 3 | 27.5 |
| Tetradecane | 4 | 26.5 |
| Dodecane | 5 | 25.5 |
| Decane | 6 | 23.8 |
| Octane | 7 | 21.6 |
| Heptane | 8 | 20.1 |

Water Repellency was tested according to the 3M Water Repellency Test II (May, 1992). The rating scale is 0-10, with "0" indicating the poorest degree of repellency (substrates having higher surface energy) and "10" indicating the best degree of repellency (substrates having lower surface energy). The 3M water repellency scale is:

1=10% isopropanol (IPA), 90% water;
2=20% IPA, 80% water;
3=30% IPA, 70% water;
4=40% IPA, 60% water;
5=50% IPA, 50% water;
6=60% IPA, 40% water;
7=70% IPA, 30% water;
8=80% IPA, 20% water;
9=90% IPA, 10% water; and
10=100% IPA.

TABLE 2

Results for Example 1

| Fabric | Contact angle | A | B | C | D |
|---|---|---|---|---|---|
| Acrylic | Octane | 139 | 149 | 145 | 140 |
| | Water Rating | 9 | 10 | 8 | 9 |
| | Oil Rating | 7 | 8 | 6 | 7 |
| NYCO | Octane | 102 | 145 | 117 | 132 |
| | Water Rating | 9 | 10 | 6 | 7 |
| | Oil Rating | 6 | 7 | 6 | 6 |

As is shown in Table 2, the fluid repellency, as measured by the octane contact angle and water and oil repellency values, are consistently better for the dual size particles than the comparative A (no particles) or CID (single particles) with respect to low surface tension liquids.

Example 2: (E-P) Comparison of Dual Particles vs No Particles)

Fabric finish formulation was produced as in Example 1, except different commercial fluorinated treatments were used (Table 3). Examples of C6 and C8 based fluorochemicals are represented. The formulations were prepared without particle addition and with addition of both particle sizes. Acrylic Fabric was dipped in solutions, padded, and heated to 150° C. for 6 minutes. Table 4 below shows water, hexadecane, and octane contact angles for each of the fabrics. The oil and water repellency ratings were measured AATCC methods (AATCC 118 is for oil repellency, AATCC 22 for spray rating). The fluid repellency, as measured by hexadecane and octane contact angles and oil repellency values, are consistently better for the dual size particles than the comparative samples without particles.

TABLE 3

Formulations for Example 2

| | E | F | G | H | I | J | K | L | M | N | O | P |
|---|---|---|---|---|---|---|---|---|---|---|---|---|
| | CE | | CE | | CE | | CE | | CE | | CE | |
| Water | 85 | 83 | 85 | 83 | 85 | 83 | 85 | 83 | 85 | 83 | 85 | 83 |

TABLE 3-continued

| Formulations for Example 2 | | | | | | | | | | | | |
|---|---|---|---|---|---|---|---|---|---|---|---|---|
| | E | F | G | H | I | J | K | L | M | N | O | P |
| Mykon ® NRW-3 | 0.5 | 0.5 | 0.5 | 0.5 | 0.5 | 0.5 | 0.5 | 0.5 | 0.5 | 0.5 | 0.5 | 0.5 |
| Envirogem ® AE02 | 0.5 | 0.5 | 0.5 | 0.5 | 0.5 | 0.5 | 0.5 | 0.5 | 0.5 | 0.5 | 0.5 | 0.5 |
| X-Cape ® DRC | 6 | 6 | | | | | | | | | | |
| X-Cape ® B2012 | | | 6 | 6 | | | | | | | | |
| AdvaPel ® H734 | | | | | 6 | 6 | | | | | | |
| AdvaPel ® J5290 | | | | | | | 6 | 6 | | | | |
| Nuva ® HPU | | | | | | | | | 6 | 6 | | |
| X-Cape ® LK-30 | 4 | 4 | 4 | 4 | 4 | 4 | 4 | 4 | 4 | 4 | 4 | 4 |
| Permafresh ® CSI | 4 | 4 | 4 | 4 | 4 | 4 | 4 | 4 | 4 | 4 | 4 | 4 |
| AEROSIL ® 380 | 0 | 1 | 0 | 1 | 0 | 1 | 0 | 1 | 0 | 1 | 0 | 1 |
| AEROSIL ®OX50 | 0 | 1 | 0 | 1 | 0 | 1 | 0 | 1 | 0 | 1 | 0 | 1 |
| | 100 | 100 | 100 | 100 | 100 | 100 | 100 | 100 | 100 | 100 | 100 | 100 |

TABLE 4

| Contact angle and wettability ratings for Example 2 | | | | | | | | |
|---|---|---|---|---|---|---|---|---|
| | | Water CA | C16 CA | C8 CA | Sample | OR | WR | Fluoro chemistry |
| X-Cape ® DRC | Zero | 169 | 122 | 104 | E | 5 | 6 | C8 |
| | Particles | 168 | 156 | 142 | F | 7 | 10 | |
| X-Cape ® B2012 | Zero | 163 | 151 | 0 | G | 6 | 7 | C6 |
| | Particles | 162 | 148 | 101 | H | 7 | 9 | |
| AdvaPel ® H734 | Zero | 166 | 156 | 0 | I | 6 | 9 | C6 |
| | Particles | 164 | 164 | 115 | J | 6 | 10 | |
| AdvaPel ® J5290 | Zero | 166 | 135 | 0 | K | 7 | 7 | C6 |
| | Particles | 157 | 151 | 141 | L | 8 | 10 | |
| Nuva ® HPU | Zero | 168 | 145 | 139 | M | 7 | 9 | C8 |
| | Particles | 167 | 156 | 149 | N | 8 | 10 | |

Example 3: (Q-R Comparison of Colloidal Articles vs No Particles)

Fabric finish formulation was produced as in Example 1, except a colloidal dispersion of nanoparticles was used (Table 5). Colloidal dispersions with average particle size 10-20 and 40-50 are represented. The formulations were prepared without particle addition and with addition of both particle sizes. Nomex, nylon-cotton blend, and acrylic fabric was dipped in solutions, padded, and heated to 150° C. for 6 minutes. Table 6 below shows water, hexadecane, and octane contact angles for each of the fabrics. The fluid repellency, as measured by hexadecane and octane contact angles and oil repellency values, are consistently better for the dual size colloidal nanoparticles than the comparative samples without particles.

TABLE 5

| Formulations for Example 3 | | |
|---|---|---|
| | Q | R |
| Water | 80 | 80 |
| Mykon NRW-3 | 0.5 | 0.5 |
| Envirogem AE02 | 0.5 | 0.5 |
| API J5290 | 6 | 6 |
| X-Cape LK-30 | 4 | 4 |
| Resin Permafresh CSI | 4 | 4 |
| Snowtex OL | 0 | 5 |
| Snowtex O | 5 | 0 |
| | 100 | 100 |

TABLE 6

| Contact angle results for Example 3 | | | |
|---|---|---|---|
| | | Q | R |
| Nomex | Water CA | 166 | 168 |
| | C16 CA | 156 | 153 |
| | C8 CA | 0 | 150 |
| NYCO | Water CA | 165 | 161 |
| | C16 CA | 142 | 155 |
| | C8 CA | 110 | 125 |
| Acrylic | Water CA | 166 | 164 |
| | C16 CA | 135 | 162 |
| | C8 CA | 0 | 153 |

Example 4: Abrasion Testing

Sample B of Example 1 above was subjected to abrasion by Taber Abrasor according to ASTM standard D3884. Samples were conditioned at 21° C. and 65% relative humidity overnight then abraded on a Taber 5135 rotating stage dual-arm abrasion system. The stage rotated at 72 rpm, using CS-10F abrasion wheels with 250 g mass. This contact angle data for samples abraded for 500 cycles (FIG. 1) showed no degradation of resistance demonstrating mechanical durability of the treatment. Notably, the durability after 3000 cycles was improved over untreated Nomex with significantly less wear for the treated sample.

Example 5: Laundering—Wash Durability

Figure 2:
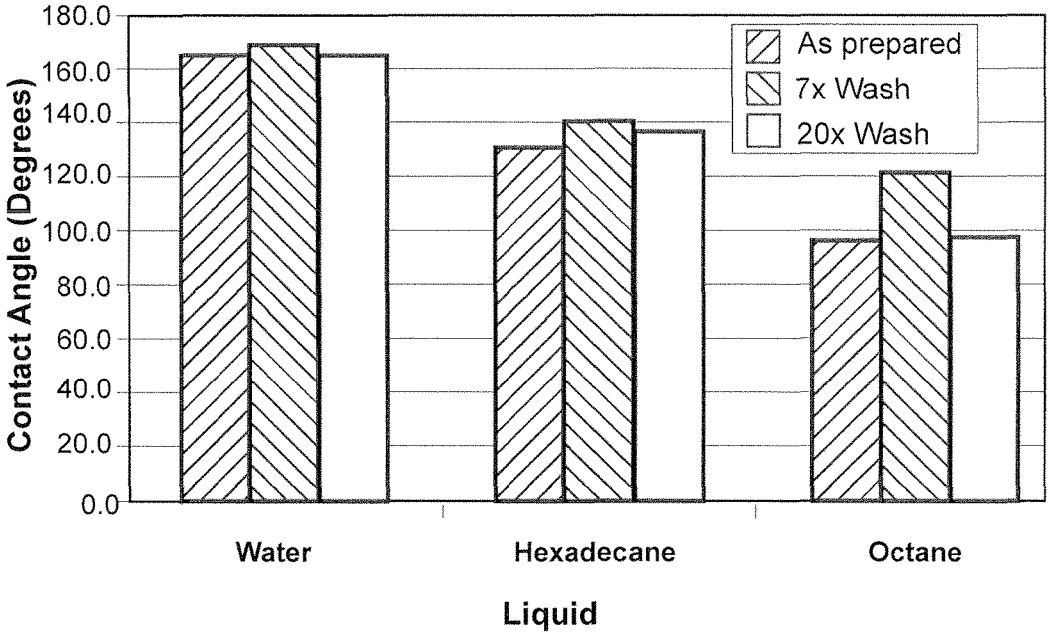
FIG. 2 is a bar graph showing the contact angles of a treated fabric as prepared and following washing 7 and 20 times according to Example 5 below.

A sample of treated fabric was washed numerous times to demonstrate wash durability. The wash cycle was performed in hot water with Tide detergent and tested for water and oil repellency before laundering, and after laundering seven times and twenty times. The results are shown in FIG. 2.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope thereof.

What is claimed is:

1. A coating composition to impart fluid-resistance to textile articles comprising:

a blend of a fluorochemical and a particulate additive comprising between about 0.1 to about 10 wt. %, based on total composition weight, of a bimodal size distribution of colloidal silica nanoparticles, wherein the bimodal size distribution of colloidal silica nanoparticles includes (i) a quantity of smaller colloidal silica nanoparticles having a mean particle diameter of between about 1 nm to about 15 nm and (ii) a quantity of larger colloidal silica nanoparticles having a mean particle diameter of between about 40 nm to about 100 nm, and wherein the smaller and larger colloidal silica nanoparticles are present in a ratio of the smaller colloidal silica nanoparticles to the larger colloidal silica nanoparticles of at least 1:2.

2. The coating formulation of claim 1, wherein the bimodal size distribution of colloidal sillica nanoparticles is present in an amount of between about 1.0 to about 2.0 wt. % based on total composition weight.

3. The composition of claim 1, wherein the fluorochemical comprises one or more organo-fluorine groups that contain a perfluorinated carbon chain having from 2 to about 16 carbon atoms.

4. The composition of claim 3, wherein the perfluorinated carbon chain is a perfluorinated aliphatic group of the general formula $C_nF_{2n+1}$, where n is an integer of at least 1.

5. The composition of claim 4, wherein n is from 4 to 8.

6. The compositions of claim 1, wherein the smaller colloidal silica nanoparticles have a particle size of between about 10-20 nm, and the larger colloidal silica nanoparticles have a particle size of about 40-50 nm.

7. The compositions of claim 1, wherein the smaller colloidal silica nanoparticles have a particle size of about 10 nm, and the larger colloidal silica nanoparticles have a particle size of about 40 nm.

8. A fluid-resistant textile article comprising a textile fabric substrate, and a coating composition according to claim 1 on the substrate.

9. A method of imparting fluid-resistance to a textile article comprising coating a textile fabric substrate with a coating composition according to claim 1.

* * * * *